US006390143B1

(12) United States Patent
Speich

(10) Patent No.: US 6,390,143 B1
(45) Date of Patent: May 21, 2002

(54) METHOD OF MANUFACTURING COLORED PATTERNED, AERIAL TEXTILE STRUCTURES, SYSTEM FOR CARRYING OUT THE METHOD AND AERIAL TEXTILE STRUCTURE FORMED IN ACCORDANCE WITH THE METHOD

(75) Inventor: Francisco Speich, Gipf-Oberfrick (CH)

(73) Assignee: Brevitex Etablissement pour l'exploitation de Brevets Textiles, Vaduz (LI)

( * ) Notice: Subject to any disclaimer, the term of this patent is extended or adjusted under 35 U.S.C. 154(b) by 0 days.

(21) Appl. No.: 09/609,852

(22) Filed: Jul. 5, 2000

Related U.S. Application Data

(63) Continuation of application No. PCT/CH99/00140, filed on Apr. 6, 1999.

(51) Int. Cl.[7] ..... D03D 45/32
(52) U.S. Cl. ..... 139/1 R; 139/232 R
(58) Field of Search ..... 139/1 R, 232 R

(56) References Cited

FOREIGN PATENT DOCUMENTS

| | | |
|---|---|---|
| DE | 4438535 | 5/1996 |
| EP | 0461514 | 12/1991 |
| EP | 0695562 | 1/1996 |
| WO | 9829588 | 7/1998 |

OTHER PUBLICATIONS

Patent Abstract of Japan No. 06330477 "Method for Printing by Multicolor Spearation", Nov. 1994.

Oelsner, A Handbook of Weaves, The Macmillan Co., 1915, pp. 350–351.*

* cited by examiner

*Primary Examiner*—John J. Calvert
*Assistant Examiner*—Robert H. Muronoto, Jr.
(74) *Attorney, Agent, or Firm*—Sidley Austin; Brown & Wood, LLP

(57) ABSTRACT

A method of manufacturing of colored, patterned areal textile structures according to which at least four weft threads of different base color are inserted in a specific constant sequence, and a constant cell is formed together with at least one warp thread, and wherein the weft threads are tied off in the cell with the warp thread so that a color cell with a specific color impression is produced.

14 Claims, 11 Drawing Sheets

Prior Art
FIG.1
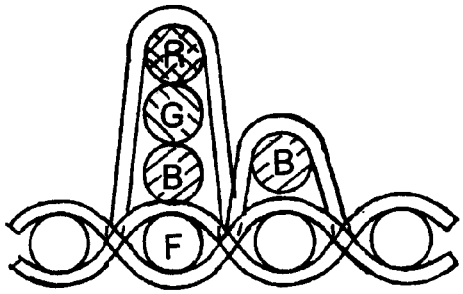
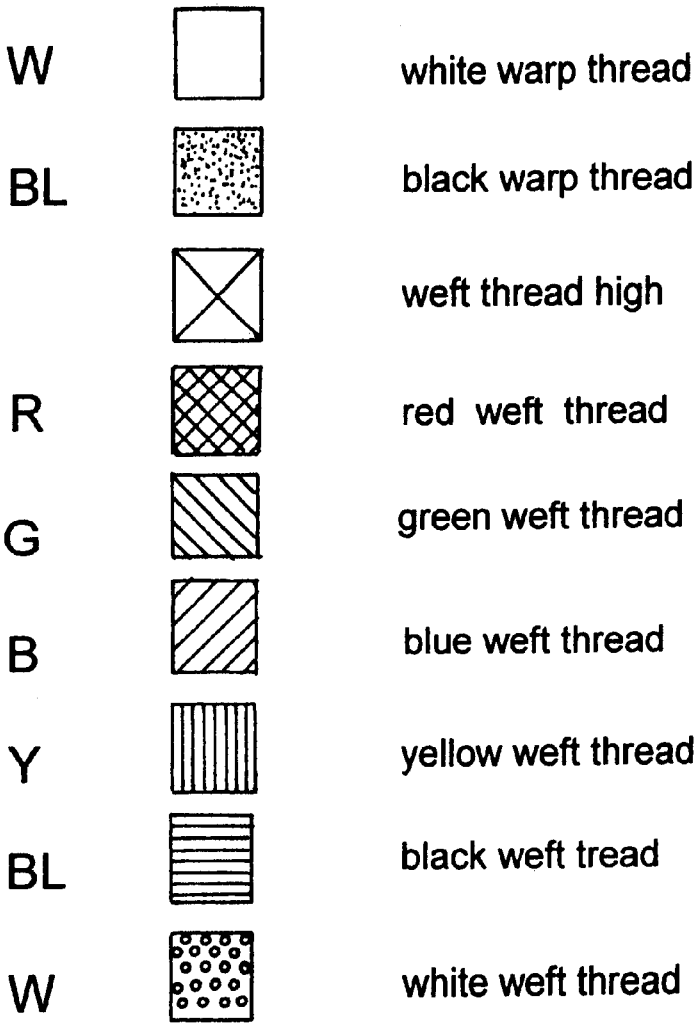
FIG.2

WHITE LINE = 54 LIGHT COLORS

BLACK LINE = 54 DARK COLORS

WHITE WARP = 54 LIGHT COLORS

BLACK WARP = 54 DARK COLORS

| | |
|---|---|
| 1 | light/red |
| 2 | dark/red |
| 3 | light/green |
| 4 | dark/green |
| 5 | light/blue |
| 6 | dark/blue |
| 7 | light/yellow |
| 8 | dark/yellow |
| 9 | light/red-green |
| 10 | dark/red-green |
| 11 | light/red-blue |
| 12 | dark/red-blue |
| 13 | light/red-yellow |
| 14 | dark/red-yellow |
| 15 | light/green-blue |
| 16 | dark/green-blue |
| 17 | light/green-yellow |
| 18 | dark/green-yellow |
| 19 | light/blue-yellow |
| 20 | dark/blue-yellow |
| 21 | light/red-green-blue |
| 22 | dark/red-green-blue |
| 23 | light/red-blue-yellow |
| 24 | dark/red-blue-yellow |
| 25 | light/green-blue-yellow |
| 26 | dark/green-blue-yellow |
| 27 | light/red-green-yellow |
| 28 | dark/red-green-yellow |

FIG.13

Color 1 light/red
Color 2 dark/red
Color 3 light/green
Color 4 dark/green
Color 5 light/blue
Color 6 dark/blue
Color 7 light/yellow
Color 8 dark/yellow
Color 9 light/black (gray)
Color 10 dark/black
Color 11 light/white
Color 12 dark/white (gray)
Color 13 light/red-green
Color 14 dark/red-green
Color 15 light/red-blue
Color 16 dark/red-blue
Color 17 light/red-yellow
Color 18 dark/red-yellow
Color 19 light/red-black
Color 20 dark/red-black
Color 21 light/red-white
Color 22 dark/red-white
Color 23 light/green-blue
Color 24 dark/green-blue
Color 25 light/green-yellow
Color 26 dark/green-yellow
Color 27 light/green-black
Color 28 dark/green-black
Color 29 light/green-white
Color 30 dark/green-white
Color 31 light/blue-yellow
Color 32 dark/blue-yellow
Color 56 dark/red-green-white
Color 57 light/green-blue-yellow
Color 58 dark/green-blue-yellow
Color 59 light/green-yellow-black
Color 60 dark/green-yellow-black
Color 61 light/green-black-white
Color 62 dark/green-black-white
Color 63 light/green-blue-black
Color 64 dark/green-blue-black
Color 65 light/blue-yellow-black
Color 66 dark/blue-yellow-black
Color 67 light/blue-black-white
Color 68 dark/blue-black-white
Color 69 light/blue-yellow-white
Color 70 dark/blue-yellow-white
Color 71 light/yellow-black-white
Color 72 dark/yellow-black-white
Color 73 light/red-green-blue-yellow
Color 74 dark/red-green-blue-yellow
Color 75 light/red-blue-yellow-black
Color 76 dark/red-blue-yellow-black
Color 77 light/red-yellow-black-white
Color 78 dark/red-yellow-black-white
Color 79 light/red-blue-black-white
Color 80 dark/red-blue-black-white
Color 81 light/red-green-yellow-black
Color 82 dark/red-green-yellow-black
Color 83 light/red-green-yellow-white
Color 84 dark/red-green-yellow-white
Color 85 light/red-green-black-white
Color 86 dark/red-green-black-white
Color 87 light/green-blue-yellow-black

FIG.14

Color 33 light/blue-black
Color 34 dark/blue-black
Color 35 light/blue-white
Color 36 dark/blue-white
Color 37 light/yellow-black
Color 38 dark/yellow-black
Color 39 light/yellow-white
Color 40 dark/yellow-white
Color 41 light/black-white
Color 42 dark/black-white
Color 43 light/red-green-blue
Color 44 dark/red-green-blue
Color 45 light/red-blue-yellow
Color 46 dark/red-blue-yellow
Color 47 light/red-yellow-black
Color 48 dark/red-yellow-black
Color 49 light/red-black-white
Color 50 dark/red-black-white
Color 51 light/red-green-yellow
Color 52 dark/red-green-yellow
Color 53 light/red-green-black
Color 54 dark/red-green-black
Color 55 light/red-green-white
Color 88 dark/green-blue-yellow-black
Color 89 light/green-blue-yellow-white
Color 90 dark/green-blue-yellow-white
Color 91 light/green-blue-black-white
Color 92 dark/green-blue-black-white
Color 93 light/blue-yellow-black-white
Color 94 dark/blue-yellow-black-white
Color 95 light/red-green-blue-yellow-black
Color 96 dark/red-green-blue-yellow-black
Color 97 light/green-blue-yellow-black-white
Color 98 dark/green-blue-yellow-black-white
Color 99 light/red-blue-yellow-black-white
Color 100 dark/red-blue-yellow-black-white
Color 101 light/red-green-yellow-black-white
Color 102 dark/red-green-yellow-black-white
Color 103 light/red-green-blue-black-white
Color 104 dark/red-green-blue-black-white
Color 105 light/red-green-blue-yellow-white
Color 106 dark/red-green-blue-yellow-white
Color 107 light/red-green-blue-yellow-black-white
Color 108 dark/red-green-blue-yellow-black-white

FIG.14a

METHOD OF MANUFACTURING COLORED PATTERNED, AERIAL TEXTILE STRUCTURES, SYSTEM FOR CARRYING OUT THE METHOD AND AERIAL TEXTILE STRUCTURE FORMED IN ACCORDANCE WITH THE METHOD

RELATED APPLICATION

This application is a continuation of International Application No. PCT/CH99/00140, filed Apr. 6, 1999 and designating the United States of America.

BACKGROUND OF THE INVENTION

1. Field of the Invention

The invention relates to a method of manufacturing colored, patterned, areal textile structures, to a system for carrying out the method, and to a flat textile structure manufactured in accordance with the method.

2. Description of the Prior Art

For the manufacturing of fabric using weaving technology with a pair of warp threads and a plurality of weft threads, a method is known in which first of all a basic weft and subsequently one or more embroidery wefts of different color are inserted in a selectable sequence into an embroidery weft line, i.e. are inserted into the weaving shed with the apparatus for the cloth take-off switched off and are interlaced by a warp thread. For the design of the loom this signifies that the apparatus for the cloth take-off must be switched off for the insertion of the embroidery weft or wefts, so that the switched transmission required for this is subject to a high dynamic loading and an electronically controlled device, for example with a servomotor, does not satisfy the requirements, and so that weft thread spools must be made available at the loom in dependence on the number of colors provided in the fabric. The restriction of the speed of rotation of the loom proves disadvantageous in addition to the technical cost and complexity and the high number of weft spools with threads of different color. In order to reduce the number of weft threads a further method has become known for the manufacture of such fabrics in which for example a basic weft F and three embroidery wefts with the colors blue, green and red are likewise inserted in an embroidery weft line and are interlaced by a warp thread and form a color cell (FIG. 1). It is pointed out that the number of embroidery wefts is not restricted. In this arrangement the embroidery wefts are inserted with the apparatus for the cloth take-off switched off. This method has the disadvantage that the fabric becomes voluminous. The disadvantages named above likewise result for the loom.

The above mentioned methods have moreover the common disadvantage that, depending on the fabric pattern, weft threads float at the rear side of the fabric, and as rule the length of the floating weft threads increases with the number of the colored weft threads.

If, in the known method, label tapes are manufactured from a broad web, then a large number of weft threads, and accordingly a large thread mass, must be cut through for the edge formation. This has the disadvantages that a high and thick brew of differing color mixture is produced at the edge of the label and a higher cutting performance is required.

A method of Jaquard weaving of a colored material is known from DE-A44 38 535. This method relates to a use of the grid methods known from printing technology with a return of the colors of the pattern to the basic colors. The representation to be woven is split up into grid points of the colors yellow, red, and blue, and also into black and white, and the material is woven from weavable points of these colors and brightness.

It has been found that on weaving with weft threads in the colors yellow, red and blue, it is not possible to achieve a color mixture as in color printing and, moreover, the number of colors is restricted. In color printing the colors are printed one after the other, whereas in weaving color cells are formed by the weft threads and the weave.

Accordingly, an object of the present invention is an improved method of manufacturing of colored, patterned areal textile structures.

SUMMARY OF THE INVENTION

According to the method of the invention the weaving technology is used with warp threads and at least four weft threads. Weft threads are used in the basic colors red, blue and yellow and in an additional color, in particular green. A color cell is formed in which four weft threads in the elementary colors red, green, blue and yellow are inserted in a specific constant sequence and are interlaced by one of the warp threads. A color impression is produced in the cell depending on the selection of the warp threads with respect to color, and depending on the interlacing of the weft threads by the warp threads. The insertion of four weft threads with different colors in the same sequence signifies for the weaving machine an advantageous and significant simplification such that, on the one hand, only four weft thread cones are required and, on the other hand, a switching off of the apparatus for the cloth take-off is avoided, so that the loom can be operated at a high speed of rotation, for example 2000 revolutions/minute. Through the respective interlacing of the weft threads, a specific color impression is produced in the color cell. The color intensity is determined by the combination of the float length of the weft thread over the warp threads and via the respective color of the warp thread which reaches the visible surface. In combination with a warp thread of a specific color, cells can be produced with fourteen different colors. It is of advantage when two warp threads of different color and a weft thread float of up to seven cells are used per cell, because in this way an areal textile structure with up to one hundred and ninety six color impressions can be produced. The color impressions are provided with a code and stored in a color scale so that the user can select the desired color impression in an advantageous and simple manner without technical interlacing manipulations. The number of color impressions can be increased by using a higher number of weft threads. Whereas the one warp thread interlaces the weft threads in accordance with the color impression to be produced, other warp threads can be interlaced at the rear side of the fabric. This has the advantage that the floating of the weft thread is eliminated.

BRIEF DESCRIPTION OF THE DRAWINGS

The invention will be explained below with reference to the accompanying drawings. The drawings show:

FIG. 1 a cross-section through a fabric manufactured in accordance with a known method, FIG. 2 a legend for the symbols used in the subsequent Figures, FIG. 3 a schematic representation of the construction of a color cell with a light red color impression formed from weft threads with four colors;

FIG. 13 a list of the color impressions of the colors which can be produced with weft threads in four colors; and FIG. 14 a list of the color impressions of the colors which can be produced with weft threads in six colors.

DETAILED DESCRIPTION OF THE PREFERRED EMBODIMENT

FIG. 2 shows the symbols or synonyms used for the characterization of the warp threads and weft threads. For a white warp thread, the symbol W and a bounded white surface is used and, for a black warp thread, the symbol BL and a bounded shaded surface is used. For a red weft thread, the symbol R and crossed hatching is used, for a green weft thread the symbol G and hatching inclined to the left is used, for a blue weft thread the symbol B and hatching inclined to the right is used, for a yellow weft thread the symbol Y and vertical hatching is used, for a black weft thread the symbol BL and a horizontal hatching is used and for a white weft thread the symbol W and hatching with circles is used. In the Figures, the warp threads extend in the vertical direction and the weft threads in the horizontal direction or perpendicular to the sheet of Figures.

Reference is made to FIGS. 3 to 6. In these Figures a warp line is shown with a black or white warp thread and also four weft threads.

Figure 3:
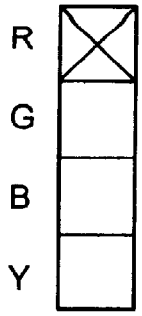
FIG. 3*a* a schematic representation of the construction of a color cell with a light red color impression formed from weft threads with six colors.
Figure 4:
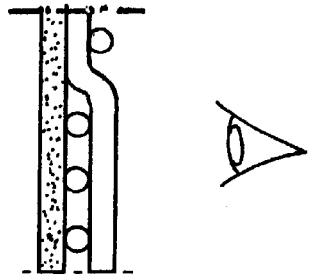
FIG. 4 a section along the warp line of the cell of FIG. 3.
Figure 5:
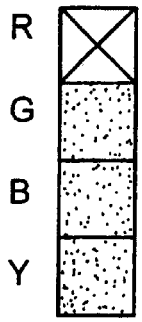
FIG. 5 a schematic representation of the construction of a color cell with a dark red color impression.
Figure 6:
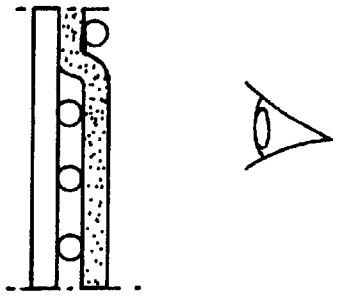
FIG. 6 a section along the warp line of the cell of FIG. 5.

With the method under discussion here a red weft thread R is inserted when the weft threads are lying downwardly, thereafter the white warp thread is lifted into the upper shed and subsequently a green G, a blue B and a yellow Y weft thread are inserted, so that a constant cell is formed together with the white warp thread, with the white warp thread covering over the green weft thread, the blue weft thread and the yellow weft thread and tying these in (FIGS. 3 and 4). If tying in takes place with the warp thread, then a color cell is formed with a color impression which is produced by the exposed red thread and the white warp thread and appears light red at the viewing side. As FIGS. 5 and 6 show, provision is likewise made in these methods for inserting a red weft thread R when the warp threads are lying low, to then lift the black warp thread into the upper shed and subsequently to insert a green weft thread G, a blue weft thread B and a yellow weft thread Y, so that a constant cell is formed together with the black weft thread, with the black weft thread floating above the green, the blue and the yellow weft thread and covering these over. If interlacing takes place with the warp thread then a color cell with a color impression is formed which is produced by the freely exposed red weft thread and the black warp thread and which appears dark red at the viewing side.

Figure 7:
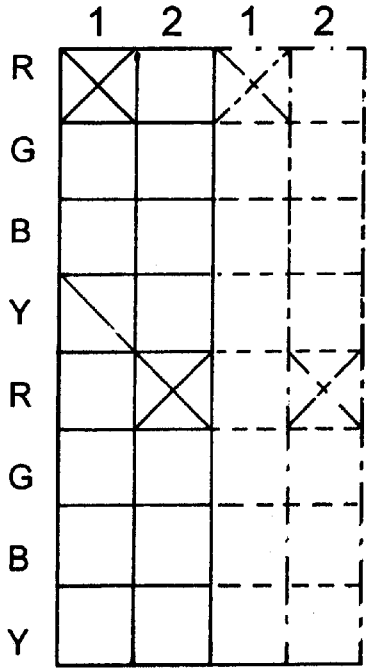
FIG. 7 a representation of the smallest weave repeat for a color cell with a light red color impression formed from weft threads with four colors.

The method is carried out on the basis of the weave repeats. FIG. 7 shows an example of the smallest weave repeat with a float length of the weft thread over a warp thread which corresponds to taffeta. The smallest weave repeat comprises two cells lying alongside one another in the weft direction and two cells lying after one another in the warp direction. FIG. 7 shows an example of a smallest weave repeat. The weave repeat comprises a first cell in accordance with FIG. 3 in the warp thread line 1 and subsequently, in the warp direction, a second cell with an upwardly lying white warp thread which covers over and ties in the weft threads red R, green G, blue B and yellow Y and in the second warp thread line a second cell with an upwardly disposed white warp thread which covers over and ties in the weft threads red R, green G, blue B and yellow Y, and subsequently, in the warp direction, a first cell in accordance with FIG. 3. With this weave repeat a bright red color impression is produced. It is self-evident for the person skilled in the art that like and dissimilar weave repeats can be assembled and repeated as desired.

Figure 8:
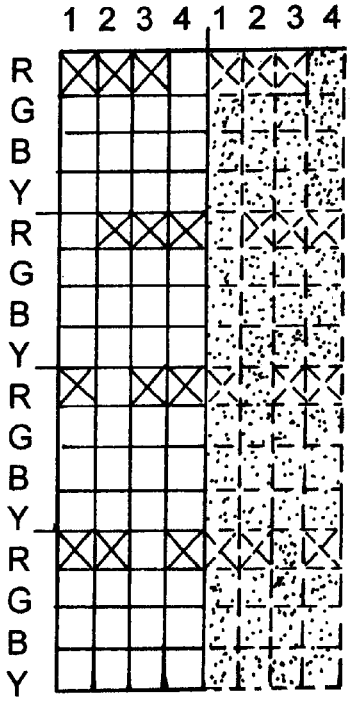
FIG. 8 a weave repeat for a color cell with a light red color impression and with a dark red color impression formed from weft threads with four colors.
Figure 3A:
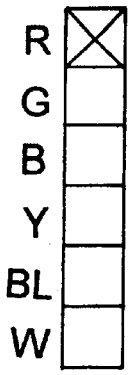
Figure 5A:
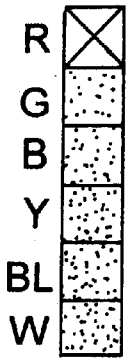
FIG. 5*a* a schematic representation of the construction of a color cell with a dark red color impression formed from weft threads with six colors.
Figure 7A:
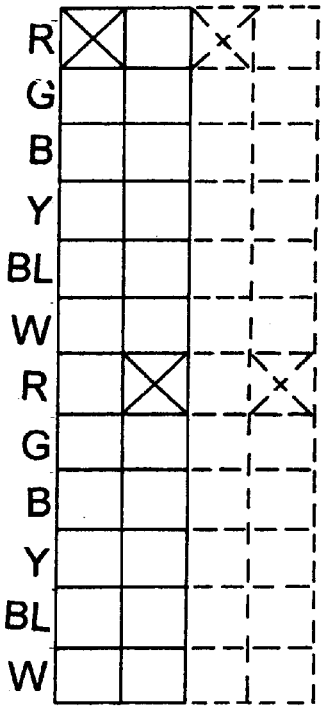
FIG. 7*a* a representation of the smallest weave repeat for a color cell with a light red color impression formed from weft threads with six colors.
Figure 8A:
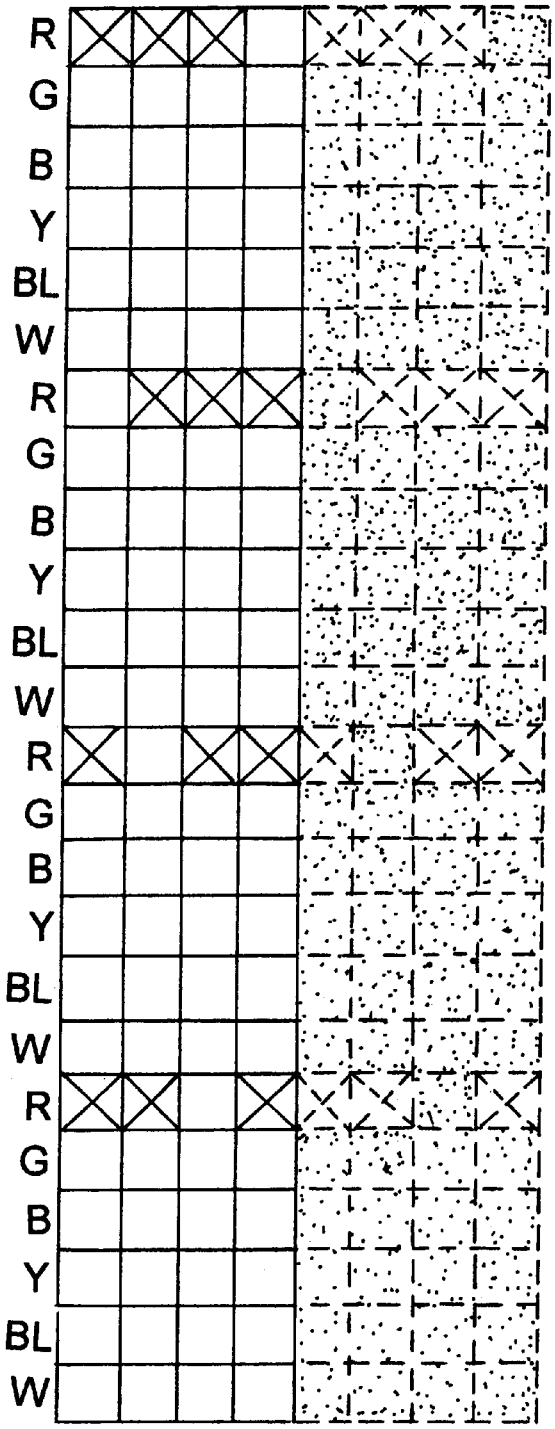
FIG. 8*a* a weave repeat for a color cell with a light red color impression and with a dark red color impression formed from weft threads with six colors.

Reference is made to FIG. 8. FIG. 8 shows two weave repeats I, II with a float length of the weft thread over three warp threads which correspond to the (3-1) body. The repeat I applies for a light red color impression and the repeat II for a dark red color impression. In the following only the repeat I will be considered. The repeat comprises four warp thread lines 1 to 4 and sixteen weft threads. In accordance with this repeat, a red weft thread R is inserted in a first step with downwardly lying warp threads of the warp thread lines 1 to 3 and with the white warp thread of the warp thread line 4 raised into the upper shed. In a second step the white warp threads of the warp thread lines 1 to 3 are raised into the upper shed. In a third step a green weft thread G, a blue weft thread B and a yellow weft thread Y are inserted one after the other into the shed. In a fourth step a red weft thread R is inserted with the warp threads in the warp thread line 1 raised into the upper shed and with downwardly lying warp threads in the warp thread lines 2 to 4. In a fifth step, the white warp threads of the warp thread lines 2 to 4 are raised into the upper shed. In a sixth step, a green weft thread G, a blue weft thread B and a yellow weft thread Y are inserted into the shed. In a seventh step, with warp threads in the warp thread line 2 raised into the upper shed and with warp threads in the warp thread lines 1, 3 and 4 lying downwardly, a red weft thread R is inserted. In an eighth step the white warp threads of the warp thread lines 1, 3 and 4 are raised into the upper shed. In a ninth step, a green weft thread G, a blue weft thread B, and a yellow weft thread Y are inserted into the shed. In a tenth step, with warp threads in the warp thread lines 3 raised into the upper shed and with warp threads in the warp thread lines 1,2 and 4 lying downwardly, a red weft thread R is inserted. In an eleventh step the white warp threads of the warp thread lines 1, 2 and 4 are raised into the upper shed. In a twelfth step a green weft thread G, a blue weft thread B and a yellow weft thread G are inserted into the shed. The repeat II is distinguished solely in that in each case the black weft threads are raised into the upper shed in place of the white weft threads.

Figure 9:
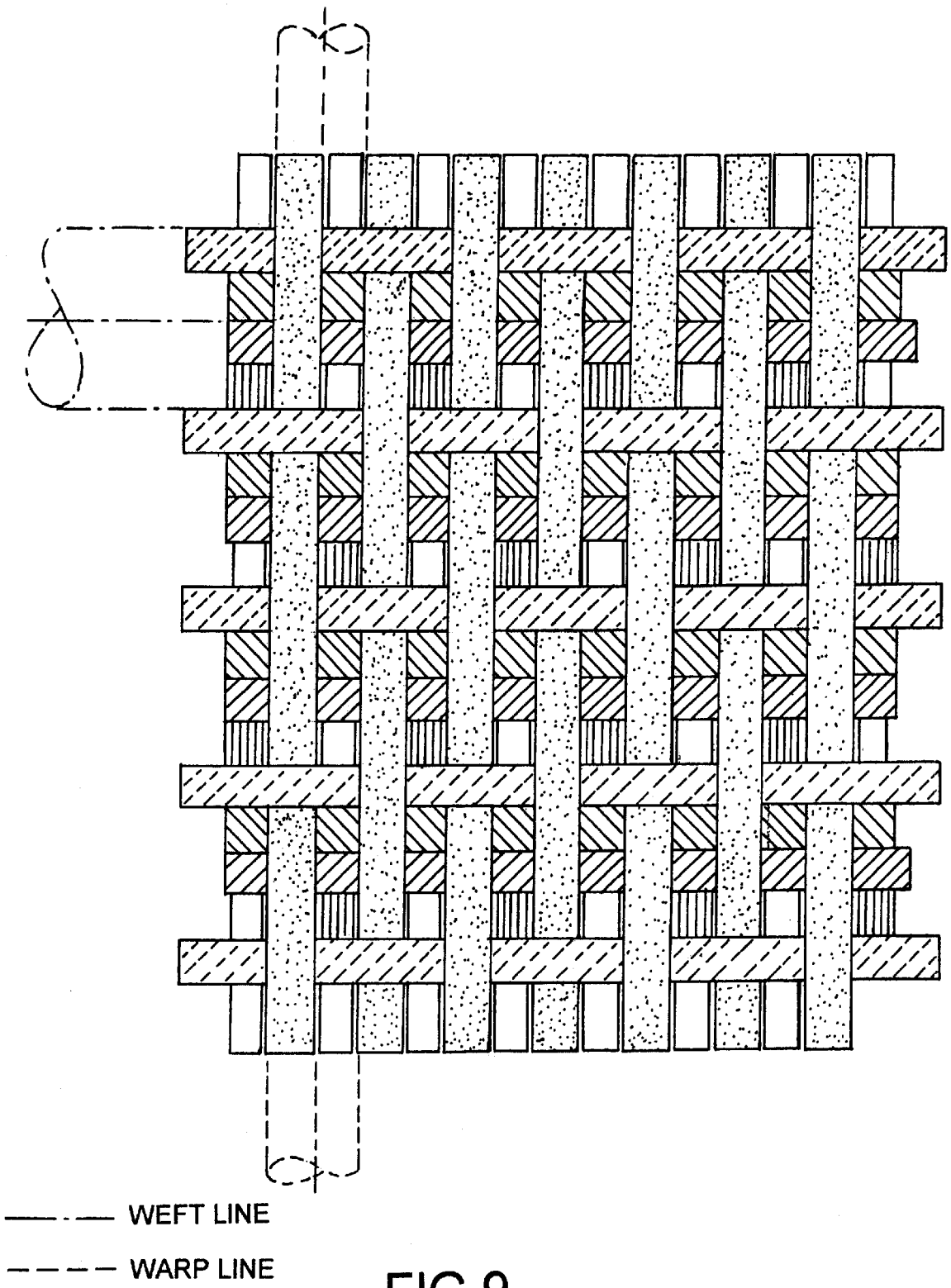
FIG. 9 a view onto the front side of a section of cloth.

FIG. 9 shows the front side of a section of fabric which was woven in accordance with the above described repeats.

Figure 10:
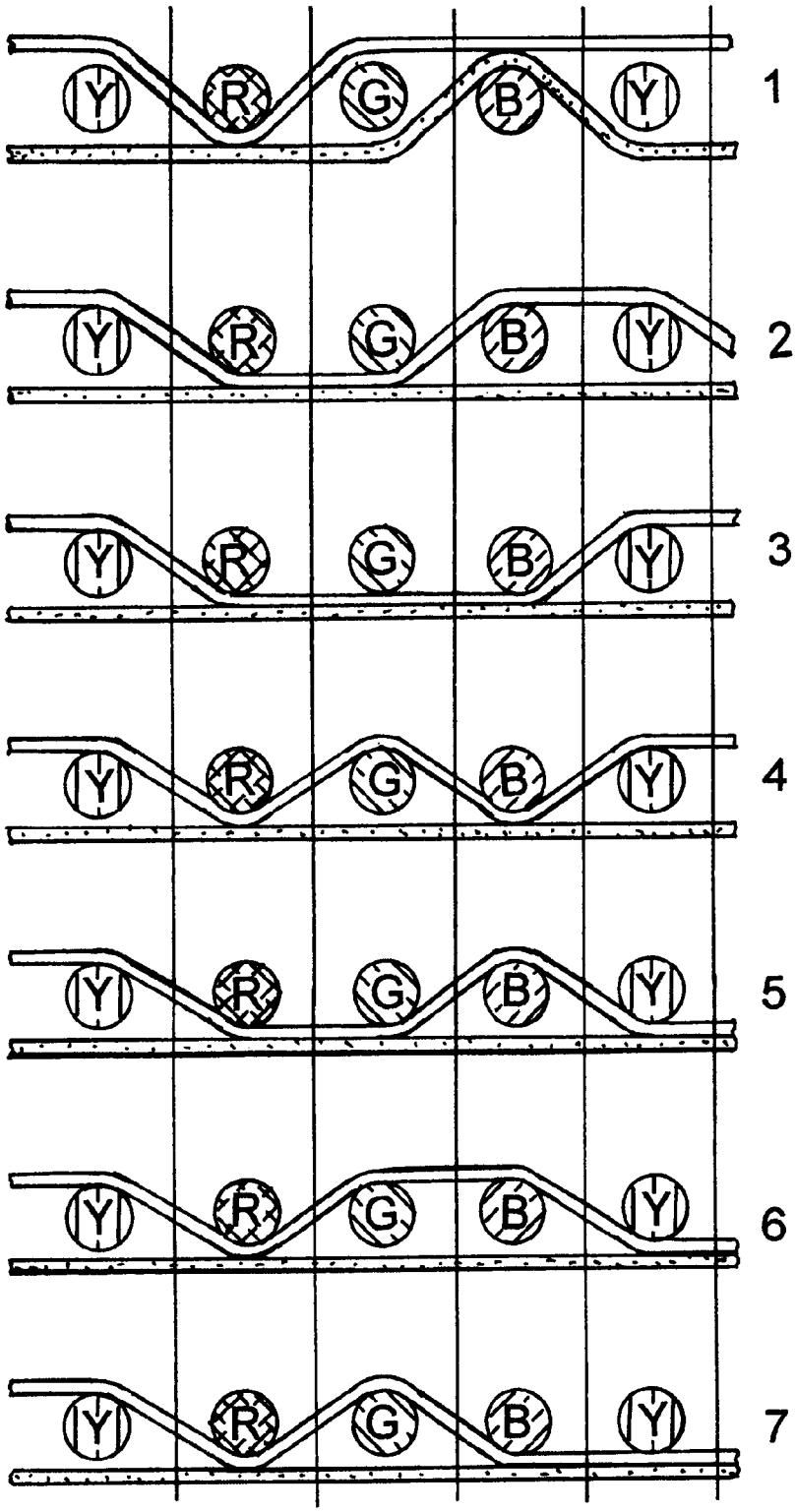
FIG. 10 sections along a warp thread line with differently interlaced weft threads.

FIG. 10 shows sections along a warp thread line with different interlacings of the warp threads. The representations are self explanatory and will thus not be described.

Figure 11:
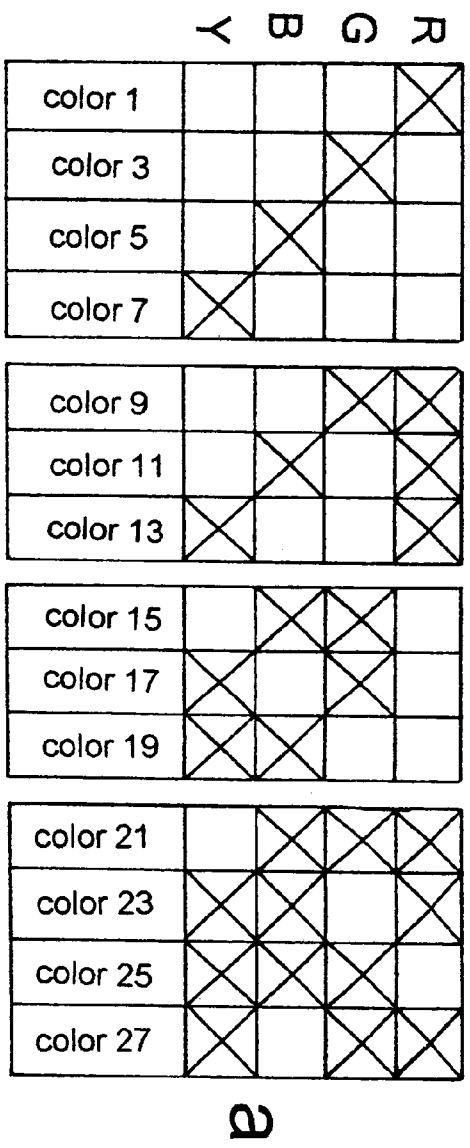
FIG. 11*a*/*b* a coded color scale of the colors which can be produced with weft threads in four colors.
Figure 11:
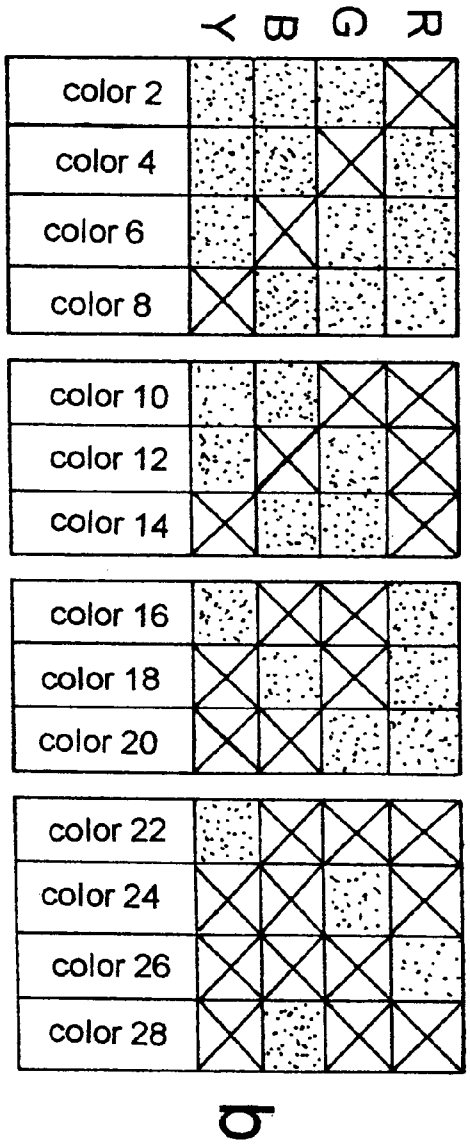

With the method of the invention twenty eight color impressions can be produced in the cells by corresponding interlacing of the weft threads with a white warp thread (FIG. 11*a*) or a black warp thread (FIG. 11*b*). These color impressions are provided with a code. The FIGS. 11*a* and 11*b* show a coded color scale.

These colors result with a float length of the weft thread over one warp thread. The float length of the weft thread can jointly extend over up to seven warp thread lines. The intensity of the color impression is determined by the float length and by the color of the warp threads, i.e. with two warp threads twenty eight intensities result. From this there results in total one hundred and ninety six color impressions, and indeed from the product of the number of colors multiplied by the number of intensities and the number of the warp threads (14×7×2=196).

With the above described method a material is woven with a specific color pattern. For the manufacture of materials with a different color pattern the sequence of the warp threads to be inserted must be correspondingly selected. In another embodiment of the method, six weft threads in the colors red, R, green G, blue B, yellow Y, black BL and white W are inserted. For this purpose the weft threads black BL and white are selectively inserted in order to produce a light or dark color impression of the color cell. This method has the advantage that the number of color impressions is further increased.

Figure 12A:
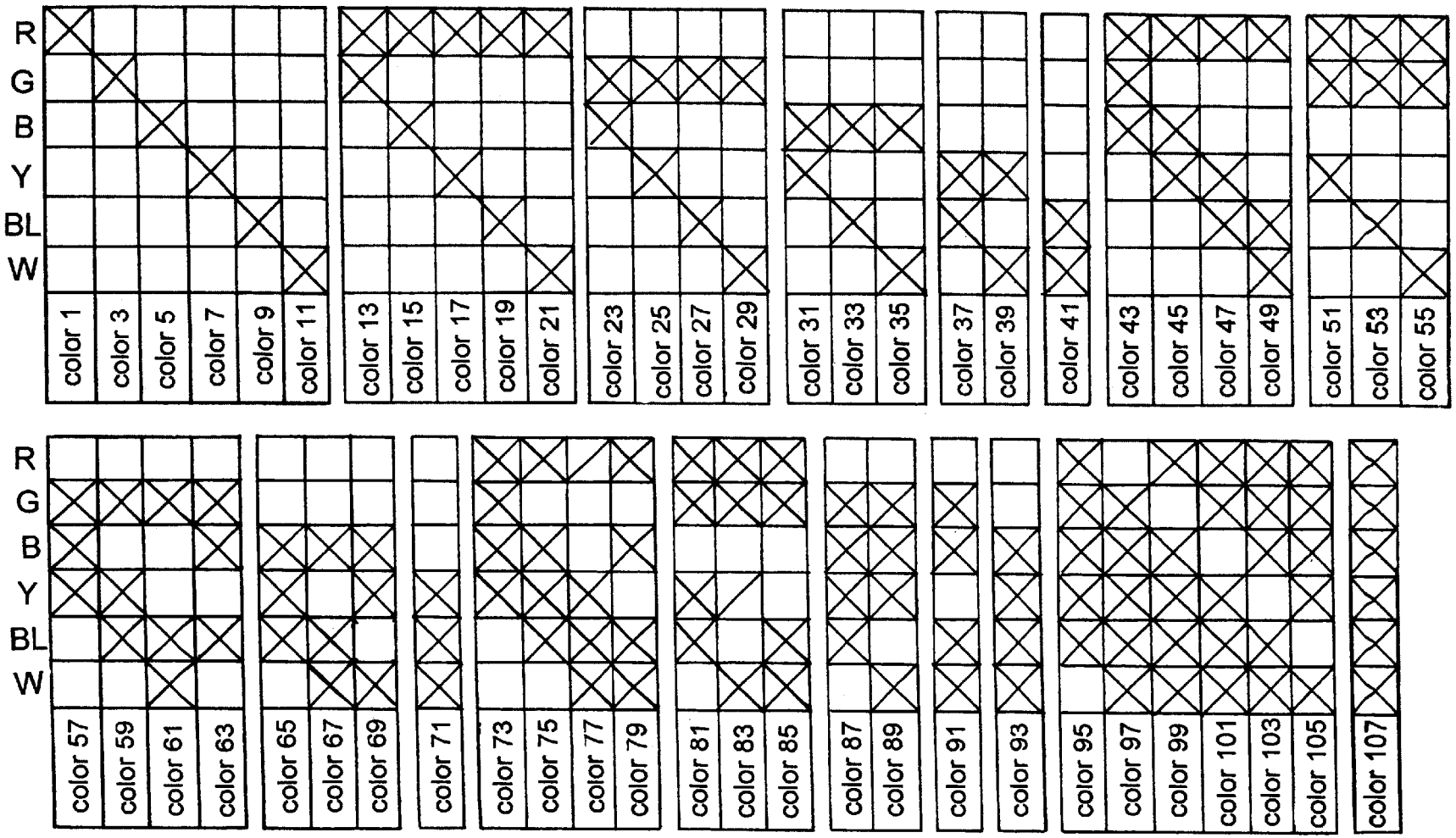
FIG. 12*a*/*b* a coded color scale of the colors which can be produced with weft threads in six colors.
Figure 12B:
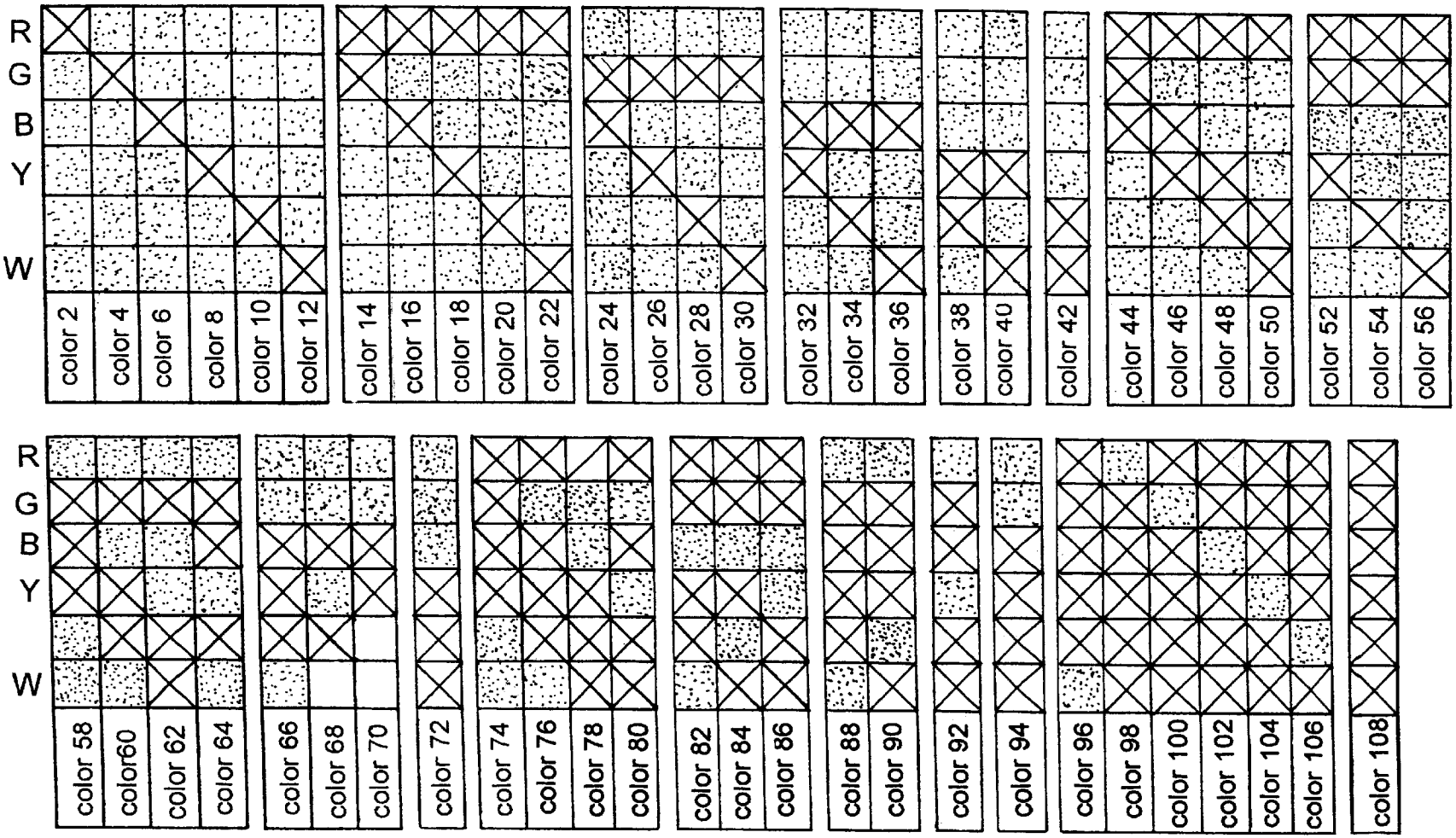

The FIGS. 12*a* and 12*b* show a coded color scale.

What is claimed is:

1. A method of producing colored patterned aerial textile structures using weaving technology with shed-forming warp threads and weft threads, comprising the steps of:

Inserting, one after another, a plurality of sets of weft threads, with each set consisting of at least four weft threads of four different base colors inserted in a same constant sequence;

interlacing the at least four weft thread of each set with at least one warp thread having a predetermined color in a predetermined manner to produce a color cell with a predetermined color impression; and gathering produced color cells together in a predetermined manner to produce a textile structure having a predetermined color pattern.

2. A method according to claim 1, wherein the sequence of introducing of weft thread can be changed for different patterns.

3. A method according to claim 1, wherein the base colors of the at least four weft threads are red, green, blue and yellow.

4. A method according to claim 1, wherein each set consists of six weft threads having six different base colors, respectively.

5. A method according to claim 4, wherein the base colors of the six weft threads are red, green, blue, yellow, black and white.

6. A method according to claim 1, wherein the interlacing step includes interlacing the weft threads with two warp threads having different colors.

7. A method according to claim 6, wherein the two warp threads have black and white colors, respectively.

8. A method according to claim 6, comprising the step of moving the two warp thread along a warp thread line upon changing of the shed.

9. A method according to claim 1, comprising the step of producing a first weave repeat which includes two cells lying alongside one another in the weft direction and two cells lying after one another in the warp direction.

10. A method according to claim 1, comprising the step of combining a plurality of cells into a second weave repeat such that special weft thread float lengths are produced and a predetermined color intensity is achieved.

11. A method according to claim 10, wherein a weft thread float length is restricted to twenty warp threads.

12. A method according to claim 1 wherein each color cell has a constant weft density.

13. A method according to claim 1, wherein at least one weft thread of the at least four weft thread of a color cell has a weft density different from a weft density of remaining weft threads which remain the same.

14. A method according to claim 1, comprising the steps of specifying a code for each color impression, and storing the code in a color scale.

* * * * *